US005581272A

United States Patent [19]

Conner et al.

[11] Patent Number: 5,581,272

[45] Date of Patent: Dec. 3, 1996

[54] SIGNAL GENERATOR FOR CONTROLLING A SPATIAL LIGHT MODULATOR

[75] Inventors: James L. Conner, Rowlett; Michael J. Overlaur, Plano; Kevin Kornher, Dallas, all of Tex.

[73] Assignee: Texas Instruments Incorporated, Dallas, Tex.

[21] Appl. No.: 111,696

[22] Filed: Aug. 25, 1993

[51] Int. Cl.[6] ..... G09G 3/34

[52] U.S. Cl. ..... 345/85; 345/108

[58] Field of Search ..... 345/84, 85, 206, 345/132, 75, 76, 98, 108, 97; 348/770, 771, 755, 756, 757, 758, 762, 764

[56] References Cited

U.S. PATENT DOCUMENTS

| | | | |
|---|---|---|---|
| 4,395,708 | 7/1983 | Lloyd | 345/98 |
| 4,723,171 | 2/1988 | Kuijk et al. | 345/85 |
| 4,725,832 | 2/1988 | Lorteije et al. | 345/85 |
| 4,740,785 | 4/1988 | Stroomer et al. | 345/85 |
| 4,786,898 | 11/1988 | Hata et al. | 345/85 |
| 4,935,670 | 6/1990 | Watanabe | 345/75 |
| 4,979,738 | 12/1990 | Frederiksen | 345/132 |
| 5,075,596 | 12/1991 | Young et al. | 345/76 |

FOREIGN PATENT DOCUMENTS

| | | | |
|---|---|---|---|
| 0467048A2 | 1/1992 | European Pat. Off. | G09G 3/20 |
| WO92/09065 | 5/1992 | WIPO | G09F 3/34 |

*Primary Examiner*—Richard Hjerpe
*Assistant Examiner*—Steven J. Saras
*Attorney, Agent, or Firm*—Charles A. Brill; James C. Kesterson; Richard L. Donaldson

[57] ABSTRACT

A method and device for controlling the bias voltages for a split-reset spatial light modulator. Each block of the spatial light modulator can be individually controlled lowering the throughput needed to load each frame of data. Blocks are selected individually or in groups with the potential of providing one voltage condition on the selected blocks and a different voltage condition on the deselected blocks. One embodiment of the disclosed method comprises input latches and buffers 44, address decode logic 46 to determine the selected blocks, mode select logic 48 to determine the requested operation, delay circuitry 50 to minimize current loading, and level shifters 52 to convert logic signals to voltage levels appropriate to control the output drive circuitry 54.

15 Claims, 2 Drawing Sheets

SIGNAL GENERATOR FOR CONTROLLING A SPATIAL LIGHT MODULATOR

FIELD OF THE INVENTION

This invention relates to the field of spatial light modulators, especially those known as digital micromirror devices, and more particularly to circuitry for controlling spatial light modulators.

BACKGROUND OF THE INVENTION

Spatial light modulators (SLMs) typically consist of an array of electronically addressable pixel elements and related control circuitry. A frequently used type of SLM is the digital micromirror device (DMD), in which each pixel element is a any micro-mechanical mirror, capable of independent movement in response to an electrical input. Incident light is modulated by reflection from each pixel. A typical application is for image display, where light from each pixel is magnified and projected to a display screen by an optical system.

DMDs can be fabricated in many different forms including the cantilever beam, hinge, and torsion beam embodiment. While the disclosed invention is equally applicable to all forms of DMDs, specific examples will reference the torsion beam digital micromirror as disclosed in U.S. Pat. No. 5,061,049, entitled "Spatial Light Modulator and Method" assigned to the same assignee as the present application.

For many applications, the SLM is binary in the sense that each pixel element may have either of two states. The element may be off, which means that it delivers no light. Or, the element may be on, which means that it delivers light at a maximum intensity. To achieve a viewer perception of intermediate levels of light, various pulse width modulation techniques may be used. Some of these techniques are described in pending U.S. Pat. No. 5,278,652, issued Jan. 11, 1994 entitled "DMD Architecture and Timing for Use in a Pulse-Width Modulated Display System" assigned to the same assignee as the present application.

In general, pulse width modulation produces an integrated brightness by switching each pixel on or off during each frame for a period that corresponds to a binary number. Pulse width modulation typically uses as "bit-frame" loading, in which data for every pixel in a frame is loaded into a memory cell associated with each pixel. One bit of data is loaded into each memory cell in the array and then all pixel elements are set to correspond to that bit-frame of data. During the display time of the current bit-frame, data for the next bit-frame is loaded. According to one pulse width modulation method, the most significant bit is displayed for ½ of a frame period, the second most significant bit for ¼ frame period, etc., with the least significant bit (LSB) representing a display time of $1/(2^n<1)$ frame period, for n-bit brightness quantization. Therefore, for 8-bits of pixel brightness quantization, the SLM is loaded eight times per frame, one bit-frame at a time.

While this is an efficient method of creating a wide range of brightness levels, it has the disadvantage of requiring a very high data transfer rate during the LSB display period. For an 8-bit data word there are 8 bit-flames of data that must be loaded during one frame period. Pulse width modulation requires that ⅛ of the data for an entire frame period must be loaded during $1/255$ $(1/(2^8-1))$ of the frame period. This peak data rate is limited by the number of pins available to transfer data and the data frequency on those pins. A high peak data rate translates into a high pin count and/or high frequency, which increases device and/or system costs. A need exists for a way to reduce this peak data rate.

SUMMARY OF THE INVENTION

The present invention discloses the timing and control circuitry to implement a split-reset method. The disclosed signal generator outputs the bias voltages required by each block of the DMD array. The signal generator is flexible enough to allow standard or split-reset bit frames and a wide range of bias, offset, and reset voltages. The signal generator efficiently implements split-reset thereby reducing the peak data rate onto the DMD array.

DETAILED DESCRIPTION OF THE PREFERRED EMBODIMENTS

Figure 1:
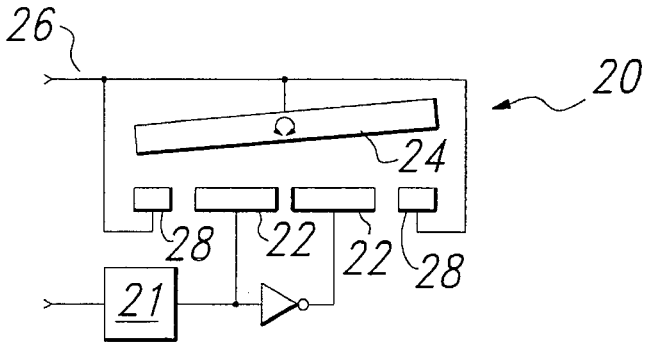
FIG. 1 is a simplified schematic view of a torsion beam DMD.

FIG. 1 depicts a simplified schematic view of a digital micromirror device (DMD). The DMD element 20 is operated by memory cell 21 applying a differential voltage to the two address electrodes 22. The charge on the address electrodes causes the mirror beam 24 to deflect towards one electrode, twisting the torsion hinges. The beam will deflect to a point where the electrostatic force displacing the beam is equal to the restoring torque of the torsion hinges. The electrostatic force is determined by the relative voltage of the beam and address electrodes and by the distance between the electrodes and the beam. The electrostatic force is increased if the voltage levels on the electrodes are increased or if a bias voltage is applied to the beam. If a high enough voltage is applied to the mirror bias supply line 26, the electrostatic force will overcome the restoring torque of the torsion hinges and the beam will rotate until the beam contacts one of the landing electrodes 28. Typically, all of the mirrors of a DMD array share a common mirror bias supply line 26.

Figure 2:
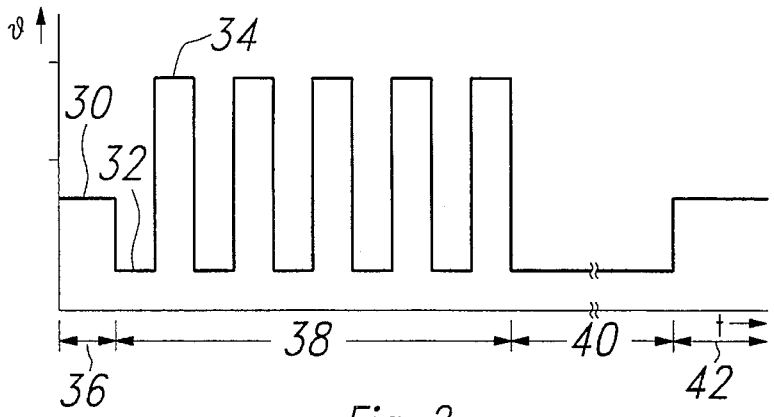
FIG. 2 is a typical mirror bias voltage waveform for a torsion beam DMD during the mirror reset period.

FIG. 2 shows a typical mirror bias waveform used to operate a torsion beam DMD. The vertical axis represents voltage and the horizontal axis represents time. Neither axis is shown to scale. In general, the bias voltages used during the bit frame period have three amplitudes. The first is the drive voltage level 30. The drive voltage is selected to be above the collapse voltage of the DMD element. This guarantees that the device is bistable and that the beam will be driven to the landing electrode when the mirror is biased by the drive voltage. The drive voltage also prevents the mirror from changing state when new data is written to the memory cell.

When the device is being reset, the mirror bias voltage is alternated between the offset voltage level 32 and the reset voltage level 34. The offset voltage level 32 is chosen to be below the bistable point of the mirrors. When the mirror bias voltage is below the bistable point, the beam deflection is a function of the mirror bias voltage and the voltage of the address electrodes. The reset voltage level 34 is a high voltage that not only causes the beam to rotate about the torsion hinges, but also to move downward towards the address electrodes causing the hinges to flex. When the reset voltage is removed abruptly, the mechanical energy stored in the hinges causes the beam to spring away from the electrodes, freeing any beams that may be stuck to the landing electrodes. One embodiment of a DMD array uses a drive voltage level 30 of 15 volts, an offset voltage level 32 of 5 volts, and a reset voltage level 34 of 30 volts.

Each bit frame can be divided into three periods. During a mirror hold period 36, the mirrors are held either on or off depending on the data written to the element before the last reset period. New data, to be effective for the next bit frame can be written to the element during the present mirror hold period. The mirrors are bistable during the mirror hold period and are prevented from changing state by the mirror hold voltage level applied to the mirror bias signal line. After the mirror hold period, the mirrors are reset. During the reset period 38 the mirror bias voltage is rapidly switched between the reset voltage level and the offset voltage level. The rate at which the voltage is switched is chosen to be faster than the response time of the mirror. A typical rate is 5 MHz. The settling period 40 after the reset period allows the array element to assume the state written to it during the last hold period. At the end of the settling period, the next mirror hold period 42 begins and the cycle repeats.

One method of reducing the peak data load rate into a DMD is the split-reset or multiplexed reset method. The split-reset method is disclosed in U.S. patent application Ser. No. 08/002,627, entitled "Pixel Control Circuitry for Spatial Light Modulator", and is assigned to the same assignee as the present invention. When using the split-reset method it is not necessary to write data to the entire DMD array at one time. One portion of the array may be written to and the mirrors for that portion reset without affecting the rest of the DMD array. This requires an independent mirror bias signal for each portion of the DMD array. Depending on the design of the DMD array, the individual portions, or blocks, of the array could be all of the elements in a row, column, or diagonal, or all the elements in a group of rows, columns, or diagonals, or sub-arrays of the DMD array.

The split-reset method has two important advantages. First, by rearranging the bit flames for each block, it is possible to only require one block to be loaded during an LSB period. For an array with eight blocks, this results in a reduction of the peak data rate by a factor of eight. The second advantage is that because only one portion of the array is receiving data at a time, the data memory may be shared among the blocks. This allows the data memory size to be reduced by a factor equal to the number of blocks in the array.

Without the split-reset method, all mirror elements in an array receive the same bias voltage. With the split-reset method, all of the mirror elements within a group or block of mirror elements receive the same bias voltage, but the bias voltage is independent of the other blocks. The disclosed signal generator provides mirror bias signals to each block of DMD elements dependent on the status of the input signals received by the signal generator. The signals that each block receives are determined by whether or not a particular block is one of the blocks explicitly addressed. The block or blocks explicitly addressed are referred to as the selected blocks. The blocks not addressed are the deselected blocks. The disclosed signal generator provides mirror bias signals to both the selected and deselected blocks. The selected blocks all receive one mirror bias signal and deselected blocks all receive another mirror bias signal.

Figure 3:
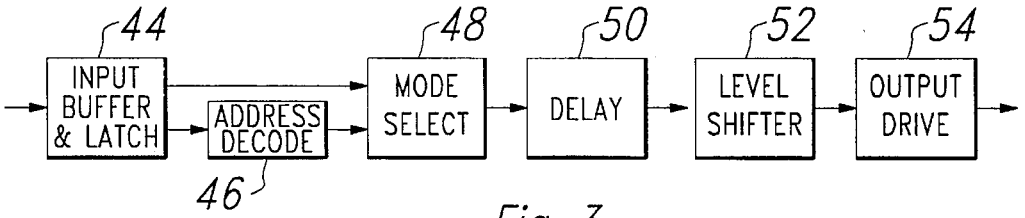
FIG. 3 is a block diagram of one embodiment of a signal generator according to the present invention.

A typical block diagram of the disclosed signal generator is shown in FIG. 3. The input buffer and latch circuit 44 is used to synchronize the input signals and drive the input signals to other portions of the signal generator. The address decode circuit 46 determines which DMD element blocks are being selected. Table 1 shows one example of decode logic for the address decode. Other decode schemes could be used with equivalent functionality.

TABLE 1

| MODE CONTROL | | ADDRESS | | | | OUTPUT SELECTED |
|---|---|---|---|---|---|---|
| 1 | 0 | 3 | 2 | 1 | 0 | BY DECODER |
| 0 | 0 | A | B | C | D | SELECTED BY ADDRESS(3:0) |
| 0 | 1 | X | X | X | X | ALL EVEN OUTPUTS |
| 1 | 0 | X | X | X | X | ALL ODD OUTPUTS |
| 1 | 1 | X | X | X | X | ALL OUTPUTS |

The decode scheme represented by Table 1 uses six block select signals to determine which blocks are selected. The six block select signals include two mode control bits and four address bits. The two mode control bits allow the user to select from four possible decode functions. The four shown in Table 1 allow any output to be selected individually, together with all other odd or even outputs, or together with all other outputs. The decode logic could be designed to yield other than the four combinations shown in Table 1, such as all lower numbered outputs. The decode logic could also use other than four address bits to allow addressing a different number of blocks.

The signal generator is designed to provide four different voltage conditions on the mirror bias supply line for each mirror block. The bias supply line can be held at the bias voltage, the offset voltage, or the reset voltage. The actual voltage levels are determined by the voltages supplied to the signal generator. The bias supply line can also be toggled between the reset and offset levels. The rate at which the bias supply line is toggled is determined by the frequency of the clock signal input to the signal generator. Two of the above voltage conditions may be provided at the same time, one condition is applied to the blocks selected by the address signals and the other condition is applied to the unselected blocks.

TABLE 2

| SELECT 2 | SELECT 1 | SELECT 0 | SELECTED BLOCKS | DESELECTED BLOCKS |
|---|---|---|---|---|
| 0 | 0 | 0 | HOLD AT BIAS | HOLD AT BIAS |
| 0 | 0 | 1 | HOLD AT OFFSET | HOLD AT OFFSET |
| 0 | 1 | 0 | TOGGLE RESET | TOGGLE RESET |
| 0 | 1 | 1 | HOLD AT RESET | HOLD AT RESET |
| 1 | 0 | 0 | HOLD AT BIAS | HOLD AT BIAS |
| 1 | 0 | 1 | HOLD AT OFFSET | HOLD AT BIAS |
| 1 | 1 | 0 | TOGGLE RESET | HOLD AT BIAS |
| 1 | 1 | 1 | HOLD AT RESET | HOLD AT BIAS |

As shown in Table 2, the mode select circuit either provides the same voltage conditions to all of the blocks whether they are selected or not, or holds the deselected blocks at the bias voltage. The mode select circuit could be modified to yield other combinations or choices. For example, if one more input were added to the decode logic, then any combination of the four voltage conditions could be selected.

The mode selector 48 contains the decode logic used to signal the rest of the signal generator which voltage conditions are to be provided to the selected blocks and which are to provided to the deselected blocks. The inputs to the mode select circuit are the three mode select lines, a decode signal for each block, and a clock signal. The clock signal is used to control the toggle rate and duty cycle of the bias supply line voltages when a block is being reset. The mode select circuit of the disclosed embodiment outputs two signals for each of the blocks being controlled. Only two signals are used in order to simplify the delay circuit. When the first signal, PHB, is active, the output for that block is the bias voltage. If PHB is inactive, the second signal, PHH, causes the output to switch between the offset voltage (PHH active), and the reset voltage (PHH inactive).

The outputs of the mode selector 48 are delayed by the delay block 50. The purpose of the delay block is to ensure that the level shifter 52 and output drive 54 blocks never attempt to provide two or more different voltages on the same bias supply line. The delay block will stop driving the signals for the last command before driving the signals for the next command. One embodiment of a delay circuit is shown in FIG. 3. The delay circuit shown in FIG. 4 uses the two signals from the mode control block to generate the signal generator output enable signals. Signals PHH 56, and PHB 58, are the inputs to the delay circuit.

Figure 4:
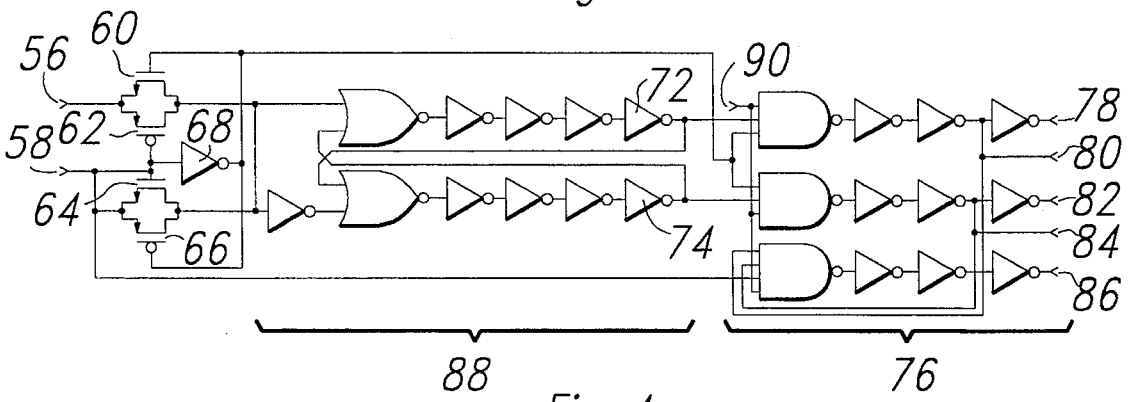
FIG. 4 is a schematic of one embodiment of a delay block of the present invention.

In FIG. 4, transistors 60, 62, 64, and 66 and inverter 68 perform an OR function on the input signals 56 and 58. The decode circuitry 76 uses the output of the delay circuitry 88 and an inverted PHB signal from inverter 68 to generate the block bias enable signals 78, 80, 82, 84 and 86.

Figure 5:
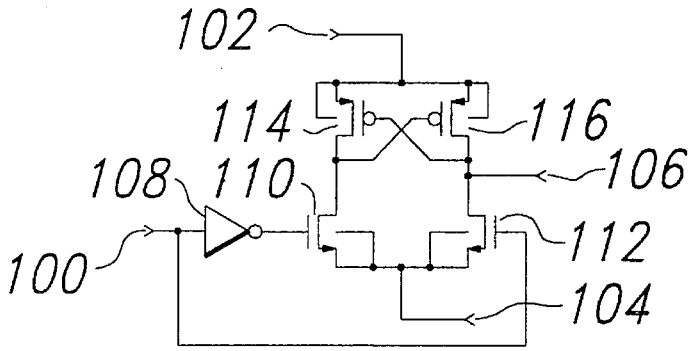
FIG. 5 is a schematic of one embodiment of a level shifter of the present invention.
Figure 6:
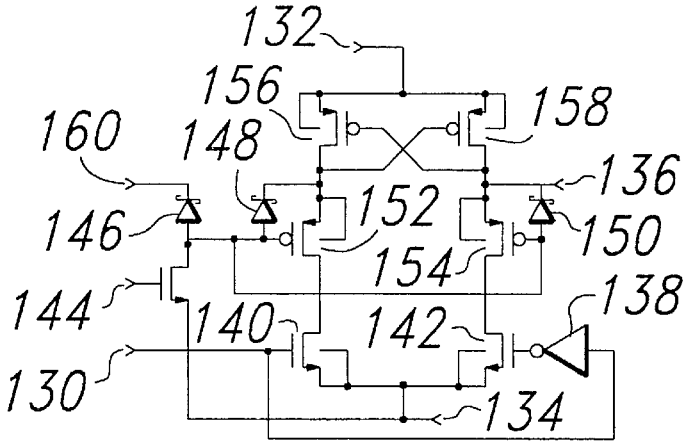
FIG. 6 is a schematic of a second embodiment of a level shifter of the present invention.

The level shifter 52 circuit is used to shift the block bias enable signals from logic levels to levels appropriate to drive the output drive circuitry 54. Two implementations of a level shifter are shown in FIGS. 5 and 6. In each implementation, the output is switched between the two bias voltage levels depending on the state of the logic input. In FIG. 5, a logic one on input 100 will cause transistor 112 to turn on and transistor 110 to turn off. This will result in turning on transistor 114 and turning off transistor 116. The output 106 is pulled low by transistor 112. If input 100 is a logic zero then the output 106 is pulled up by transistor 116. The level shifter of FIG. 6 operates in a similar manner. FIG. 6 includes additional protection circuitry to guard against damage from large voltage swings. The level shifter of FIG. 6 is used when the design rules for the fabrication technology require limiting the voltage being switched by a transistor. In this example the level shifter of FIG. 6 is needed to switch the 30 volt mirror reset signal. There are three level shifters for each SLM block controlled by the disclosed signal generator.

Figure 7:
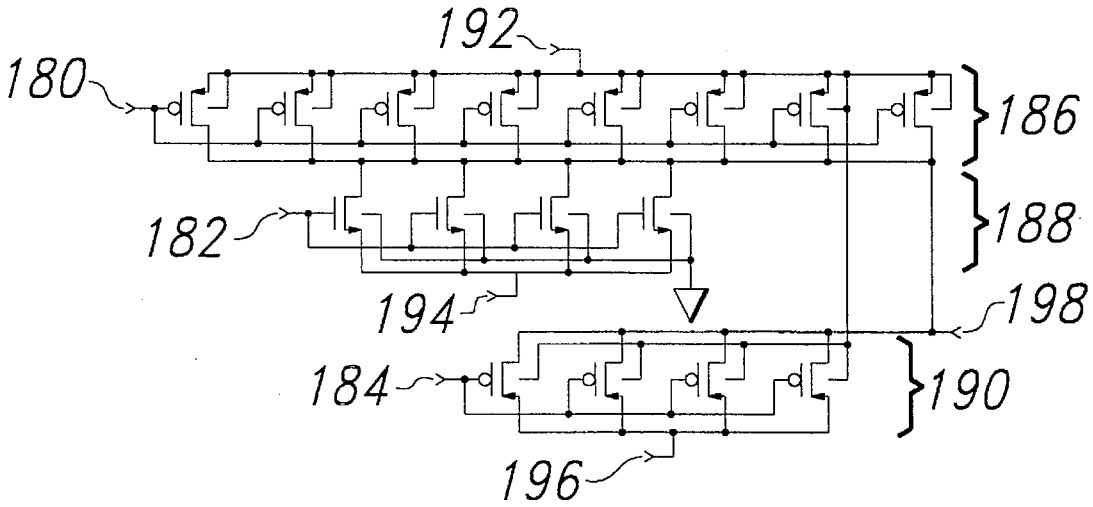
FIG. 7 is a schematic of one embodiment of an output driver of the present invention.

The output drive block 54 contains transistors that are used to switch the appropriate voltages onto each of the block mirror bias supply lines. As shown in FIG. 7, the three voltage signals from the level shifters, 180, 182, and 184, each switch one bank of transistors, 186, 188, and 190. When a bank of transistors is turned on, one of the SLM bias voltages, 192, 194, or 196, is output to the SLM on line 198. Line 198 is the mirror bias voltage supply line for one block of the SLM. A separate output drive circuit controls each block of the SLM. As mentioned earlier, the function of the delay circuit 50 is to ensure that only one of the transistor banks is turned on at a time. This prevents the high currents that would result from shorting two bias voltages together.

Thus, although there has been disclosed to this point a particular embodiment for a signal generator for controlling the split-reset spatial light modulator, it is not intended that such specific references be considered as limitations upon the scope of this invention except in-so-far as set forth in the following claims. Furthermore, having described the invention in connection with certain specific embodiments thereof, it is to be understood that further modifications may now suggest themselves to those skilled in the art, it is intended to cover all such modifications as fall within the scope of the appended claims.

What is claimed is:

1. A signal generator for controlling a spatial light modulator, wherein said spatial light modulator is comprised of blocks of modulator elements, comprising:

a block selector to select at least one block of said spatial light modulator; and an output drive connected to said block selector and to each block of said spatial light modulator to simultaneously provide a reset signal to said at least one selected block of said spatial light modulator and a hold signal to each unselected block of said spatial light modulator, whereby said modulator elements in said selected blocks of said spatial light modulator elements are reset while said modulator elements in said unselected blocks continue to hold data.

2. The signal generator of claim 1 wherein said output drive includes means for switching a voltage to each block of said spatial light modulator.

3. The signal generator of claim 1 wherein said output drive comprises at least one transistor to switch a voltage to each block of said spatial light modulator.

4. The signal generator of claim 1 wherein said block selector simultaneously selects all even numbered blocks.

5. The signal generator of claim 1 wherein said block selector simultaneously selects all odd numbered blocks.

6. The signal generator of claim 1 wherein said block selector simultaneously selects all said blocks.

7. The signal generator of claim 1 wherein said block selector selects an individual block determined by an address input to said block selector.

8. The signal generator of claim 1 further comprising a delay block to ensure that said output drive stops providing a first voltage before providing a second voltage.

9. The signal generator of claim 1 further comprising a level shifter to shift the voltage level of the signals controlling said output drive to the voltage levels necessary to properly bias the output drive transistors.

10. The signal generator of claim 1 wherein said reset signal comprises a voltage oscillating between two levels.

11. The signal generator of claim 10 wherein said oscillation is performed at a rate determined by an external clock.

12. A signal generator for controlling a spatial light modulator, wherein said spatial light modulator is comprised of blocks, comprising:

a block selection decoder to select at least one block of said spatial light modulator, said block selection decoder enabling the selection of either all even numbered blocks simultaneously, all odd numbered blocks simultaneously, all blocks simultaneously, or one block individually, said selection based on address and block select signals input to said block selection decoder;

a mode selection decoder to determine what operation should be performed on each selected block and each non-selected block, said determination based on mode select signals input to said mode select decoder and whether or not each block is selected as determined by the output of said block selection decoder;

a delay circuit to ensure that said output drive circuit stops driving the control or bias signals necessary to perform one operation before supplying the control or bias signals necessary to perform a second operation;

a level shifter circuit to shift the voltage level of the signals controlling said output drive to the voltage levels necessary to properly bias the output drive transistors; and an output drive circuit connected to said mode selection decoder and to each block of said spatial light modulator to supply the control or bias signals necessary to perform said operations on said blocks, said output drive comprising at least one transistor to switch a bias voltage to each block of said spatial light modulator.

13. A method of controlling a spatial light modulator, wherein said spatial light modulator is comprised of at least two groups of modulator elements, said method comprising:

providing block select and mode select signals;

decoding said block select signals to select at least one said groups of modulator elements;

decoding said block select signals to determine which of said groups of modulator elements are selected to receive an element reset signal; and providing an element reset signal to said groups of modulator elements selected to receive said element reset signal while simultaneously providing a different voltage signal to a remainder of said groups of modulator elements.

14. The method of Claim 13 wherein said step of providing an element reset signal is comprised of providing an oscillating voltage signal to said groups of modulator elements selected to receive said element reset signal.

15. The method of Claim 15 wherein said step of simultaneously providing a different voltage signal is comprised of providing a hold signal to said remainder of said groups of modulator elements whereby data being displayed by said remainder of said groups of modulator elements continues to be displayed while said groups of modulator elements selected to receive said element reset signal are reset.

* * * * *